United States Patent [19]

Larrison

[11] Patent Number: 4,942,974

[45] Date of Patent: Jul. 24, 1990

[54] TAMPER EVIDENT CONTAINER

[75] Inventor: Owen D. Larrison, Hacienda Height, Calif.

[73] Assignee: Sealright Company, Inc., Kansas City, Mo.

[21] Appl. No.: 366,531

[22] Filed: Jun. 9, 1989

[51] Int. Cl.[5] ..... B65D 53/00; B65D 55/02

[52] U.S. Cl. ..... 220/214; 220/319; 220/307; 220/257

[58] Field of Search ..... 220/270, 214, 319, 308, 220/307, 257

[56] References Cited

U.S. PATENT DOCUMENTS

| | | | |
|---|---|---|---|
| 4,071,157 | 1/1978 | Appellaniz | 220/214 |
| 4,146,148 | 3/1979 | Dwinell | 41/32 |
| 4,453,646 | 6/1984 | Harrild | 220/270 |
| 4,488,658 | 12/1984 | Smith et al. | 17/40 |
| 4,493,432 | 1/1985 | Smith | 17/34 |
| 4,572,393 | 2/1986 | Kobayashi et al. | 220/270 |
| 4,643,329 | 2/1987 | Mobberley et al. | 51/20 |
| 4,682,702 | 7/1987 | Gach | 220/270 |
| 4,759,463 | 7/1988 | Mazoin | 220/270 |

*Primary Examiner*—Joseph Man-Fu Moy

[57] ABSTRACT

A tamper evident container assembly for perishable foods such as dairy products. A container is provided with a removable lid which mechanically interlocks with the container in a conventional fashion. A fragible ring is wedged onto the lid to prevent release of the mechanical interlock and removal of the lid. A frangible tab section of the ring must be broken away to release the ring and permit removal of the lid. Absence or breakage of the ring provides visual evidence of possible product tampering.

14 Claims, 1 Drawing Sheet

TAMPER EVIDENT CONTAINER

BACKGROUND OF THE INVENTION

This invention relates in general to packaging and more particularly to a container for foods and other products which is constructed in a manner to provide visual evidence that the container has been opened.

Cottage cheese, sour cream, yogurt, ice cream and other food products are normally packaged in relatively inexpensive "tub" type containers. These containers are typically formed from coated paperboard or injection molded or thermoformed thermoplastic materials such as polyethylene or polystyrene. In order to prolong the shelf life of the product, the container is provided with a tightly fitting lid which mechanically interlocks with the rim of the container. Removal of the lid permits access to the container contents and the mechanical interlock permits resealing of the container by simply pressing the lid back onto the container.

One problem with conventional food containers of this type is that the lid can be easily removed and replaced while the container is on the store shelf without providing a visual indication of such removal and replacement. Product tampering may then take place and a potential purchaser would have no way to determine upon examination of the container that tampering of the contents has occurred.

In an effort to combat the possibility of tampering with the contents of food containers, the packaging industry has attempted to make available containers which are either tamper-proof or tamper evident. Although tamper evident containers can be opened while still on the shelf in a store, the fact that they have been opened is evidenced by an easily visible indicator which alerts the public to the fact that tampering has occurred.

One particularly satisfactory type of tamper evident container is set forth in U.S. Pat. No. 4,643,329 to Mobberley et al. Mobberley discloses a container having a plastic disk insert which is fitted on top of a conventional container lid. The disk is wedged tightly in place and is of sufficient rigidity to prevent release of interlocking portions of the lid and the container. When the lid is to be removed by the consumer, the disk has a frangible center portion which is broken away to permit removal of the remaining annular ring. While this type of construction is particularly effective to provide visual evidence of container tampering, the disk covers the entire lid area and prevents the lid from being used to display product information at the point of sale.

SUMMARY OF THE INVENTION

It is an object of this invention to provide a tamper evident container assembly for the packaging of foods and other products which provides effective evidence of tampering yet does not obstruct a major portion of the lid surface so that product information may be printed on the lid surface for viewing by the consumer prior to purchase.

It is also an important object of this invention to provide a tamper evident container assembly which permits easy removal of the tamper evident mechanism when initial access to the container contents is desired so that the container assembly may be readily opened by consumers.

As a corollary to the preceding objects, it is another object of this invention to provide a tamper evident mechanism which may be used with conventional lid constructions so that the expense associated with a new lid design is avoided.

To accomplish these and other related objects of the invention, a tamper evident container assembly is provided which utilizes a container and a lid having mechanical interlocking portions which permit removal and replacement of the lid as desired. The interlock between the container and lid may be provided by a peripheral groove formed on the container and a mating peripheral bead portion of the lid. The tamper evident feature is provided by a rigid, frangible ring which is carried to the top of the lid. The edge of the ring is wedged tightly against the inner face of the lid portion which is positioned within the groove formed on the container to prevent release of the lid. A tab is formed on the ring and may be easily separated from the remainder of the ring along score lines to permit removal of the ring when initial removal of the lid is desired. When the ring is removed or broken, the consumer is alerted to the fact that product tampering may have taken place.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
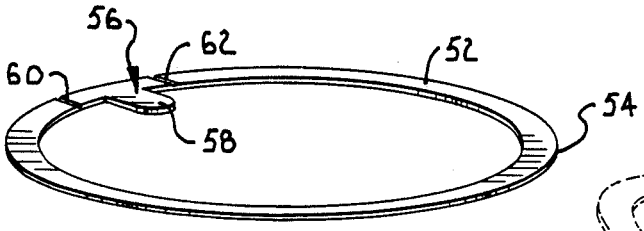
FIG. 1 is a perspective view of a ring which is included in the tamper evident container assembly of the present invention.

Referring now to the drawings in greater detail, the numeral 10 generally designates a container for the packaging of perishable foods such as dairy products in the nature of cottage cheese, sour cream, ice cream or yogurt. The container 10 may be formed from coated paperboard, or injection molded or thermoformed thermoplastic, although other materials may also be utilized. The container 10 is a "tub" type container having frustoconical sidewall 12 and a discoidal bottom (not shown) which encloses the bottom of the container.

It should be understood that the container 10 may serve to hold other types of food products or other consumable products. It should also be understood that the container may have other configurations other than that shown in the drawings.

Figure 2:
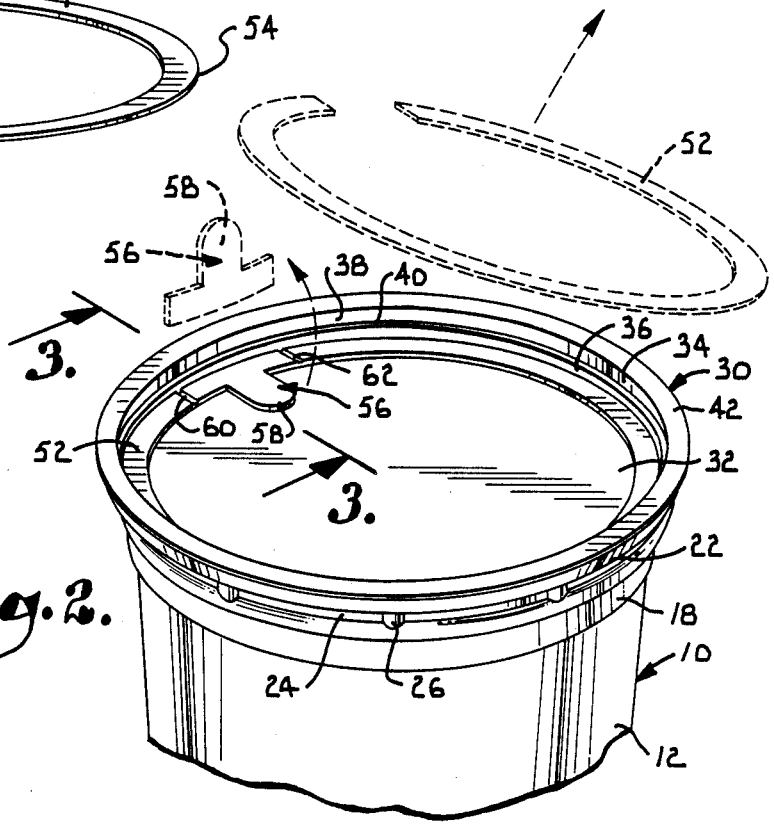
FIG. 2 is a fragmentary perspective view of the tamper evident container assembly with broken lines illustrating the manner in which the ring is removed from the container lid.
Figure 3:
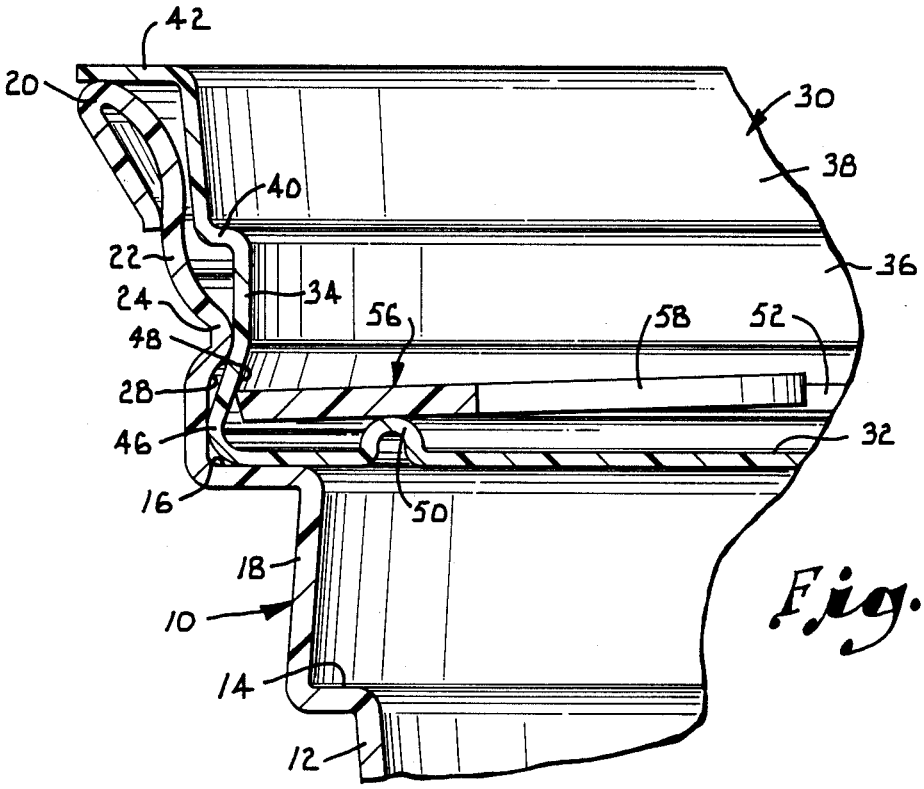
FIG. 3 is a fragmentary sectional view of the container assembly on an enlarged scale taken along line 3—3 of FIG. 2.

The construction of the container sidewall 12 can best be seen with reference to FIG. 3. The sidewall 12 includes a lower annular shoulder 14 and an upper annular shoulder 16 which are separated by a generally vertical wall section 18. An outwardly rolled rim 20 is formed at the top edge of container sidewall 12 to define the top edge of the container. A generally vertical wall section 22 extends upwardly from annular shoulder 16 and includes a plurality of circumferentially spaced, inwardly projecting ribs 24. As can be seen in FIG. 2, ribs 24 are uniformly spaced and are separated by a plurality of outwardly projecting spacers 26.

A continuous annular groove or channel 28 is formed on the inner face of wall section 22 between annular shoulder 16 and ribs 24. The open side of channel 23 faces inwardly to form the container portion of a mechanical interlock between the container and a removable lid 30.

Access to the contents of the container 10 is provided through an open top defined within container rim 20. The removable lid 30 is provided to seal the contents of the container. Lid 30 has a generally flat, discoidal body 32 which is provided on its peripheral edge with a generally vertical wall 34. Wall 34 is divided into lower and upper sections 36 and 38 by an annular shoulder 40. A horizontal flange 42 extends outwardly at the top edge of wall section 38. When the lid is placed on the container, wall section 38 and horizontal flange 42 contact the upper portion of container wall section 22 with the container rim 20 engaging the undersurface of horizontal flange 42.

The discoidal body 32 of lid 30 is sized to overlay container annular shoulder 26. An outwardly projecting bead 46 is formed in the lower section of the lid wall 34 immediately above body portion 32. The circumferential dimension of bead 46 is sized to fit tightly within container channel 28 to secure the lid to the container and to seal the contents. The bead 46 thus cooperatively functions with container channel 28 to releasably interlock the lid to the container. The deformable nature of the lid wall 34 permits bead 46 to be depressed inwardly to remove the bead from channel 28 so that the lid can be removed from the top of the container.

A channel 48 is formed immediately inside bead 46 in lid wall 34. Channel 48 opens inwardly with its open side facing toward the center of lid body 32. An annular rib 50 projects upwardly from lid body 32 and is spaced inwardly from channel 48.

A tamper evident ring 52 is provided for the container assembly and is preferably formed from a plastic material that may be, if desired, somewhat stiffer and more rigid than container 10 or lid 30. The ring 52 includes a beveled outer peripheral edge 54 and a frangible tab 56 which has an inwardly projecting lifting portion 58. The frangible tab 56 is defined by spaced apart scorelines 60 and 62 which extend between the inner edge and outer edge 54 of the ring. To facilitate removal of the ring, the score lines are spaced apart a sufficient distance so that the circumference of ring 52 may be reduced upon removal of the tab 56.

Ring 52 is applied to lid 30 in a manner to prevent removal of the lid from the container 10 while the ring is in place. The outer peripheral edge 54 of the ring is received within channel 48 of the lid and is sized to wedge tightly against the wall 34. The rigidity of ring 52 when positioned on lid 30 prevents deformation of the lid so that bead 46 may not be released from container channel 28.

Ring 52 is preferably inserted on top of the lid 30 prior to initial enclosure of the container 10 by application of the lid to the container. Once the lid and ring are in place, initial opening of the container requires that the ring 52 first be removed. To facilitate removal, the ring is spaced above the lid body 32 by the annular rib 50 to permit finger access to the frangible tab 56. Upward lifting of the tab 56 as illustrated in FIG. 2 causes scorelines 60 and 62 to completely sever to result in detachment of tab 56. Removal of the tab leaves a gap in the ring 52 which facilitates removal of the ring by allowing the circumference of the ring to be reduced. The ring can then be easily removed from the lid by simply lifting it upward with the fingers. After the ring has been removed in this manner, the lid can be removed and replaced as desired.

It can thus be seen that ring 52 provides visual evidence of any container tampering but leaves a major portion of the lid body 32 available for product information. While the ring is in place on the lid, removal of the lid from the container is prevented. If the ring has been removed or the frangible tab has been severed, the consumer is alerted to the fact that the container may have been opened and tampering of the contents may have occurred.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A tamper evident container assembly comprising:

a container having a hollow interior for holding materials packaged therein and an open top for providing access to the interior and the contents thereof;

a removable lid applicable to the container to close said top thereof, said lid covering said top of the container when applied thereto and presenting a peripheral portion engaging the container in a manner to releasably retain the lid on the container, said peripheral portion being deformable to release from the container to permit removal of the lid; and a relatively stiff annular ring member overlying the lid and having a central opening therethrough exposing the lid and informational material thereon, said ring member being in engagement with said peripheral portion of the lid to resist deformation of said peripheral portion and said ring member having a frangible section which may be broken away to release the ring member from the lid to permit initial removal of the lid from the container.

2. The invention of claim 1, including an annular rib carried on a top surface of the lid to engage and space said ring member from a body portion of said lid.

3. The invention of claim 1, wherein said frangible section includes a score line providing a weak area along which the frangible section may be severed for removal of the ring member.

4. The invention of claim 1, wherein said frangible section includes a pair of spaced apart score lines extending from an inner to an outer edge of said ring member for providing weak areas along which the frangible section may be severed for removal of the ring member.

5. The invention of claim 4, wherein said frangible section includes a lifting tab for facilitating breakage of said frangible section.

6. The invention of claim 1, wherein:

said peripheral portion of the lid comprises a bead; and said container has a wall presenting a groove therein for tightly receiving said bead in a manner to releasably hold the lid on the container.

7. A tamper evident container assembly comprising:

a container having a hollow interior for holding materials packaged therein and an open to for providing access to the interior and the contents thereof;

a removable lid applicable to the container to close said top thereof, said lid covering said top of the container when applied thereto;

mechanical interlocking portions carried on said lid and container to releasably retain the lid on the container, said interlocking portion of the lid being deformable to release from the interlocking portion of the container to permit removal of the lid; and a relatively stiff annular ring member overlying the lid and having a central opening therethrough exposing the lid and informational material thereon, said ring member being in engagement with said interlocking portion of the lid to resist against deformation thereof and said ring member having a frangible section which may be broken away to permit removal of the ring member from the lid when initial removal of the lid from the container is desired.

8. A tamper evident container assembly comprising:

a container having a hollow interior for holding materials packaged therein and an open top for providing access to the interior and the contents thereof;

a removable lid applicable to the container to close said top thereof, said lid covering said top of the container when applied thereto;

mechanical interlocking portions carried on said lid and container to releasably retain the lid on the container, said interlocking portion of the lid being deformable to release from the interlocking portion of the container to permit removal of the lid; and a ring member on the lid and in engagement with said interlocking portion of the lid to resist against deformation thereof, said ring member having a frangible section to permit removal thereof from the lid when initial removal of the lid from the container is desired.

9. The invention of claim 8, including an annular rib carried on a top surface of the lid to engage and space said ring member from a body portion of said lid.

10. The invention of claim 8, wherein said frangible section includes a score line providing a weak area along which the frangible section may be severed for removal of the ring member.

11. The invention of claim 8, wherein said frangible section includes a pair of spaced apart score lines extending from an inner to an outer edge of said ring member for providing weak areas along which the frangible section may be severed for removal of the ring member.

12. The invention of claim 11, wherein said frangible section includes a lifting tab for facilitating breakage of said frangible section.

13. The invention of claim 11, wherein said lid interlocking portion comprises a bead and said container interlocking portion comprises a wall presenting a groove therein for tightly receiving said bead in a manner to releasably hold the lid on the container.

14. The invention of claim 13, wherein said ring member has a size and shape to wedge tightly against said bead to resist deformation thereof.

* * * * *